US010455314B1

(12) United States Patent
Yang et al.

(10) Patent No.: US 10,455,314 B1
(45) Date of Patent: Oct. 22, 2019

(54) AIR BLADDER HEADBAND CUSHION

(71) Applicant: Plantronics, Inc., Santa Cruz, CA (US)

(72) Inventors: Joseph W Yang, San Jose, CA (US); Gregor Daniel Magnusson, Santa Cruz, CA (US)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 16/014,982

(22) Filed: Jun. 21, 2018

(51) Int. Cl.
*H04R 25/00* (2006.01)
*H04R 1/10* (2006.01)

(52) U.S. Cl.
CPC ..... *H04R 1/105* (2013.01); *H04R 1/1008* (2013.01); *H04R 1/1058* (2013.01)

(58) Field of Classification Search
CPC ..... H04R 1/1008; H04R 1/1058
USPC ..... 381/378
See application file for complete search history.

(56) References Cited

U.S. PATENT DOCUMENTS 5,551,094 A 9/1996 Navone
8,661,570 B2 3/2014 Huh

*Primary Examiner* — Phylesha Dabney
(74) *Attorney, Agent, or Firm* — Chuang Intellectual Property Law

(57) ABSTRACT

Methods and apparatuses for headbands and headband cushions are disclosed. In one example, an air bladder headband cushion includes a base layer arranged to be attached to a headband, and an inflatable and deflatable air bladder cushion disposed along a length of a surface of the base layer. The inflatable and deflatable air bladder cushion includes a plurality of individualized cushions configured so that when the inflatable and deflatable air bladder cushion is in an inflated state at least one individualized cushion has a first maximum height with respect to the inner surface of the headband different from a second maximum height of a second individualized cushion, and at least one individualized cushion has a contoured surface having a varying height with respect to the inner surface of the headband.

22 Claims, 10 Drawing Sheets

AIR BLADDER HEADBAND CUSHION

BACKGROUND OF THE INVENTION

Head-worn devices such as headphones and headsets often utilize a headband which is worn over the user's head. The headband operates to support and position the earphones worn on the user's ears. In many cases, head-worn devices are worn for extended periods of time. Furthermore, head-worn devices may be worn in a variety of contexts, including situations where the user is in movement. As such, comfort, fit, and stability are critical to their design. In the prior art, headband cushions are typically composed of foam or rubber alone. Problematically, these foam or rubber cushions are fixed in thickness and limited in cushioning compression. Furthermore, they are heavy and prone to heat build-up. Since head-worn devices must be capable of being worn by a variety of users having different sized and shaped heads, achieving a comfortable, secure fit is difficult. As a result, improved methods and apparatuses for headbands for head-worn devices are needed.

BRIEF DESCRIPTION OF THE DRAWINGS

The present invention will be readily understood by the following detailed description in conjunction with the accompanying drawings, wherein like reference numerals designate like structural elements.

DESCRIPTION OF SPECIFIC EMBODIMENTS

Figure 1:
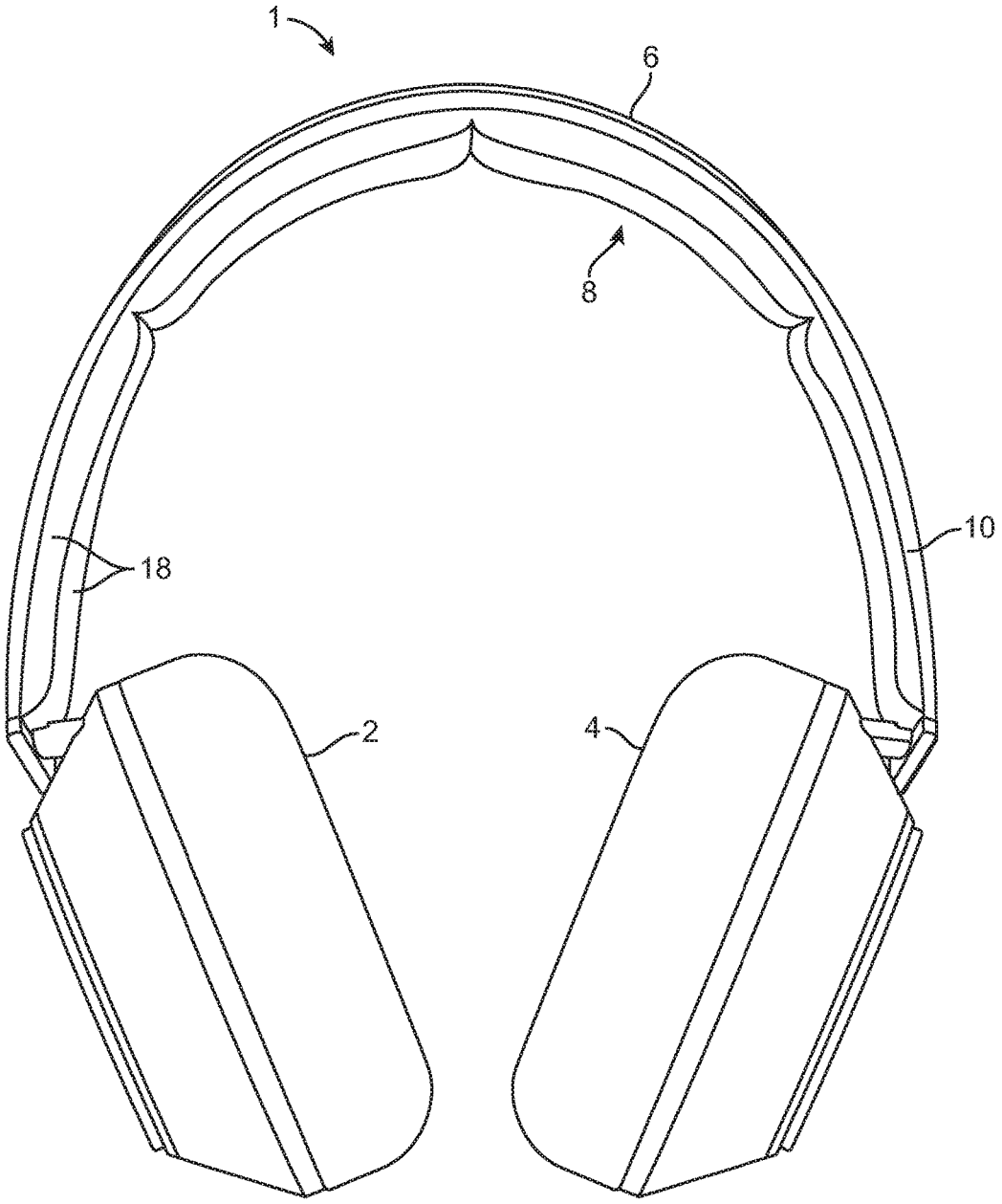
FIG. 1 illustrates a front view of a headphone having an air bladder cushion in one example.

Methods and apparatuses for headbands and headband cushions are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein.

For purpose of clarity, details relating to technical material that is known in the technical fields related to the invention have not been described in detail so as not to unnecessarily obscure the present invention. It is to be understood that various example of the invention, although different, are not necessarily mutually exclusive. Thus, a particular feature, characteristic, or structure described in one example embodiment may be included within other embodiments unless otherwise noted.

In one example, an air bladder cushion is positioned on the wearer's head when the user puts on a headphone. Advantageously, the size of the air bladder cushion 8 self-adapts (i.e., automatically conforms) to the wearer's head as an air bladder is inflated, accommodating a variety of head sizes and shapes. The air bladder cushion may be covered by a material such as leather which contacts the user head. By increasing or decreasing the air pressure of the air bladder balloon structure forming the cushion, the curvature of the headband is size-tailored to the end-user. The cushion is designed to have varying heights so that at select locations, an increased height is provided to contact select points on the user head for maximum support, stability, and comfort. In one example, the use of parallel tracks of inflated individualized cushions provides additional clamping force when the headphones are worn, resulting in increased stability. Since air within the air bladder cushion is used as a compressible material, weight is reduced. Furthermore, the use of the air bladder cushion reduces heat buildup relative to prior art materials, providing increased comfort to the wearer during extended wear.

In one example embodiment, an air bladder headband cushion includes a base layer arranged to be attached to a headband, and an inflatable and deflatable air bladder cushion disposed along a length of a surface of the base layer. The inflatable and deflatable air bladder cushion includes a plurality of individualized cushions configured so that when the inflatable and deflatable air bladder cushion is in an inflated state at least one individualized cushion has a first maximum height with respect to the inner surface of the headband different from a second maximum height of a second individualized cushion, and at least one individualized cushion has a contoured surface having a varying height with respect to the inner surface of the headband. The air bladder headband cushion further includes a foam layer.

In one example embodiment, a head-worn device includes a left earphone assembly, a right earphone assembly, and a headband having a first end coupled to the left earphone assembly and a second end coupled to the right earphone assembly. The headband includes an inflatable and deflatable air bladder cushion disposed along a length of an inner surface of the headband. The inflatable and deflatable air bladder cushion includes a plurality of individualized cushions configured so that when the inflatable and deflatable air bladder cushion is in an inflated state at least one individualized cushion has a first maximum height with respect to the inner surface of the headband different from a second maximum height of a second individualized cushion, and at least one individualized cushion has a contoured surface having a varying height with respect to the inner surface of the headband. The headband further includes a foam layer arranged along a length of the length of the inner surface of the headband.

Figure 2:
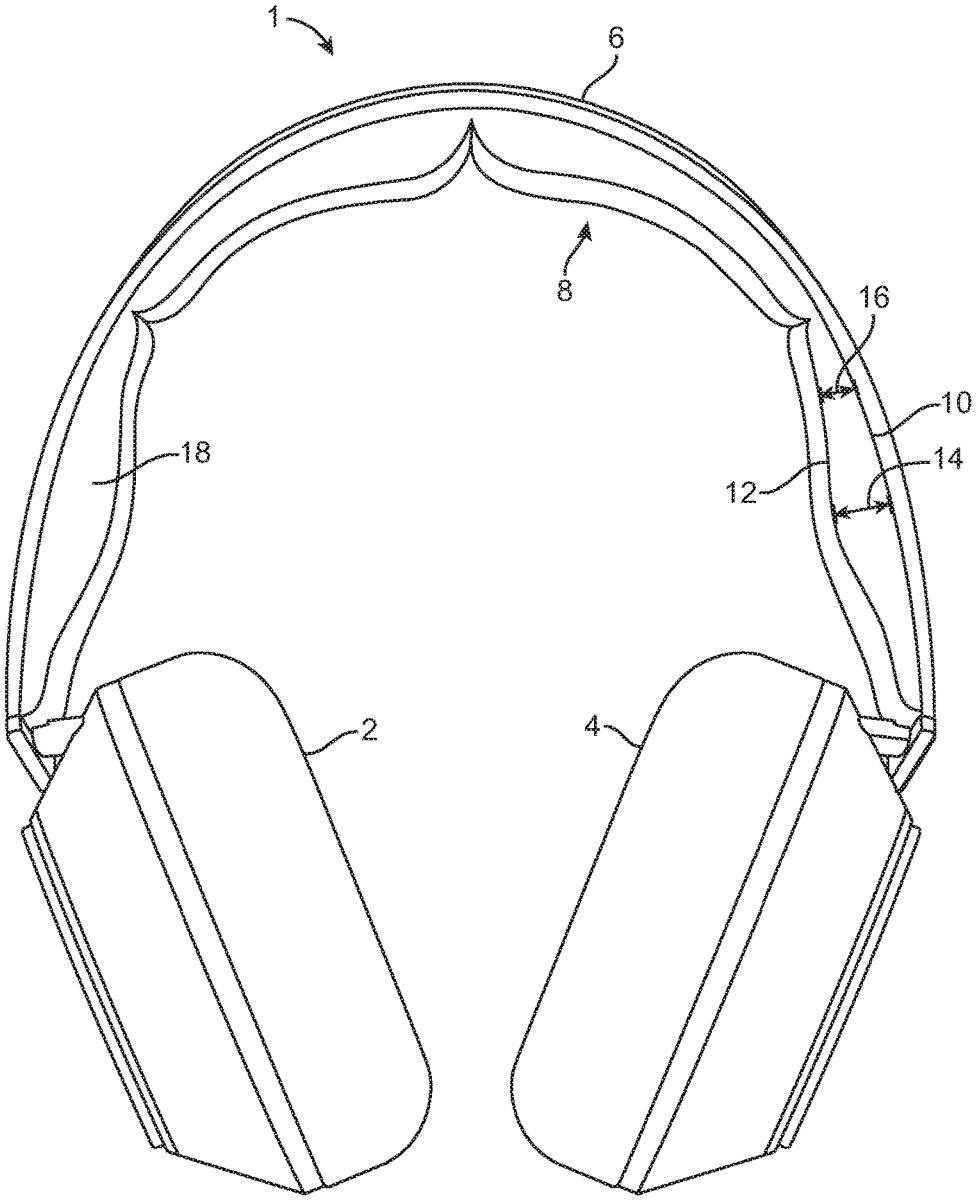
FIG. 2 illustrates the headphone shown in FIG. 1 in which the air bladder cushion is in an inflated state.
Figure 3:
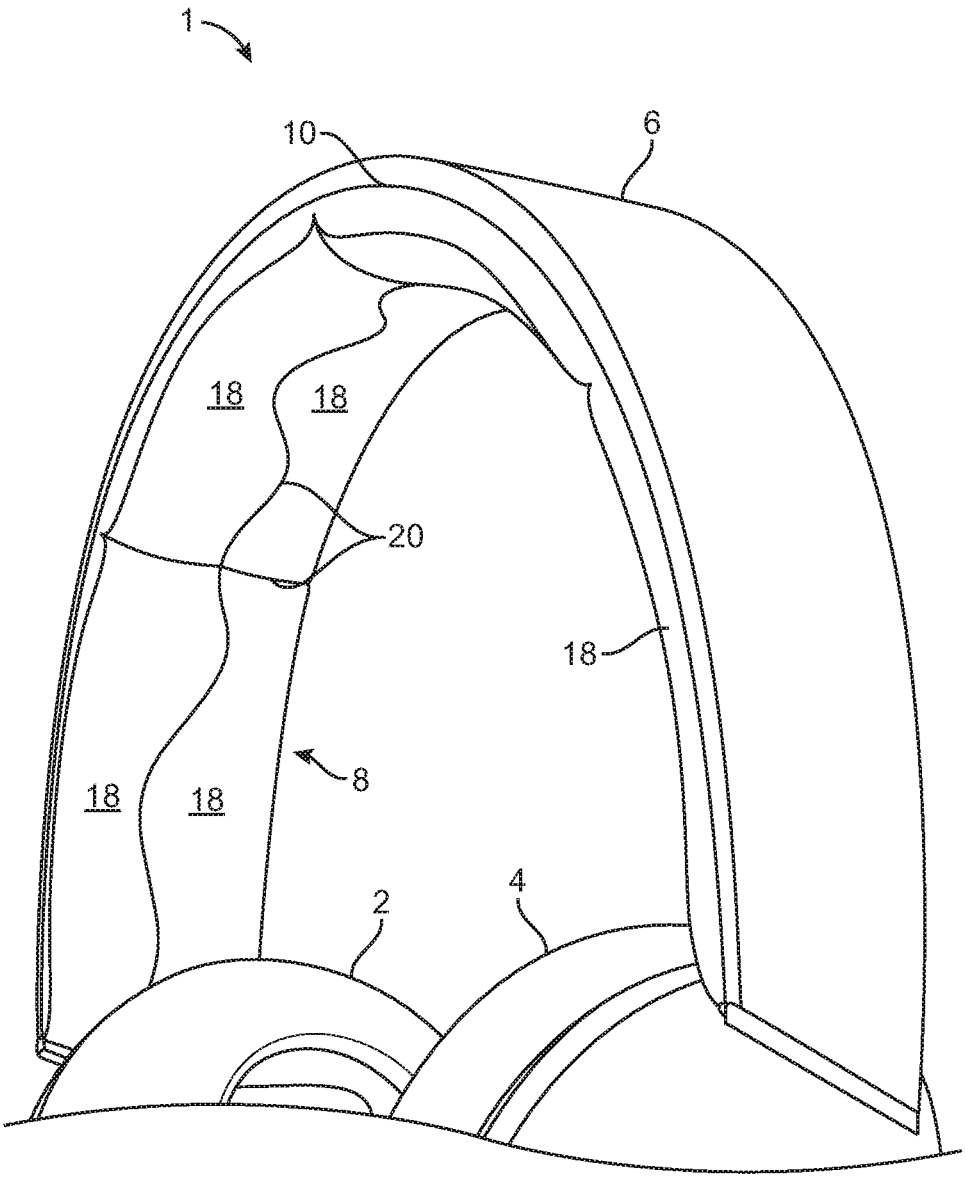
FIG. 3 illustrates a perspective view of the individualized cushions delineated by a heat seal pattern of the air bladder cushion shown in FIG. 1.
Figure 4:
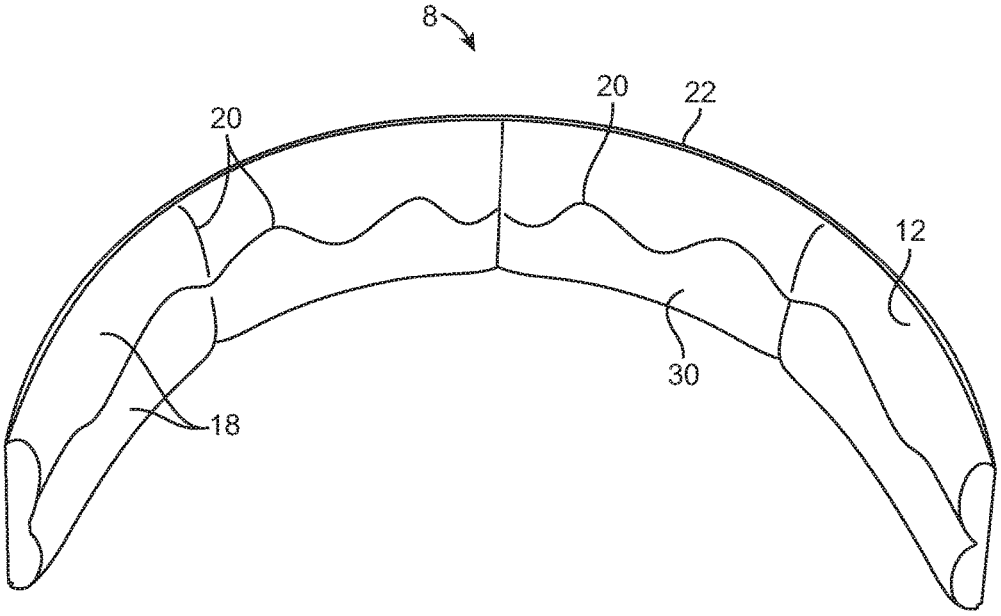
FIG. 4 illustrates the air bladder cushion shown in FIG. 1 including a base layer and top surface.
Figure 9:
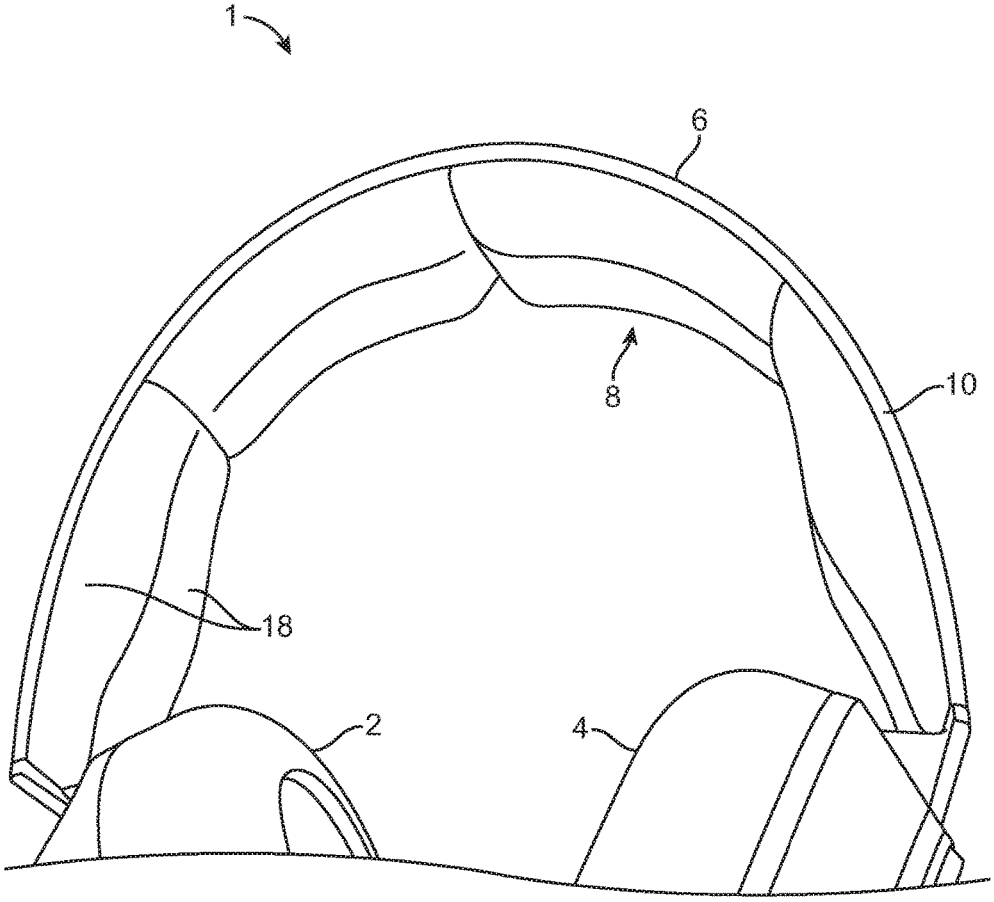
FIG. 9 illustrates a further perspective view of the headphone having an air bladder cushion.

Referring to FIGS. 1-5, a headphone 1 having an inflatable and deflatable air bladder cushion 8 is illustrated in one example embodiment. FIG. 1 illustrates a front view of the headphone 1 having the air bladder cushion 8. FIG. 2 illustrates the headphone 1 in which the air bladder cushion 8 is in an inflated state. FIG. 4 illustrates the air bladder cushion 8 shown in FIG. 1 including a base layer 22 and top layer 30 (i.e., an air bladder). FIG. 9 illustrates a further perspective view of the headphone 1 having an air bladder cushion 8.

Headphone 1 includes a left earphone assembly 2, a right earphone assembly 4, and a headband 6 having a first end coupled to the left earphone assembly 2 and a second end coupled to the right earphone assembly 4. In one arrangement, the earphone assemblies 2, 4 are coupled to the headband 6 includes a ball-and-socket type joint. This joint provides the earphone assemblies 2, 4 the ability for angular motion in all directions, thereby enabling them to adjust to any ear shape when placed on the user ear. In a further embodiment, a yoke style arrangement may be utilized.

Each earphone assembly 2, 4 includes an earphone (i.e., an audio transducer unit) disposed therein, and an ear cushion disposed on the outer housing for contact with the user ear when worn. The ear cushion operates both to provide comfort as well as serve the purpose of sealing around the user ear to keep in sound reproduced by the audio transducer unit. The shown left earphone assembly 2 and right earphone assembly 4 are merely one example among many which can be used with the headband 6.

Headband 6 includes an inflatable and deflatable air bladder cushion 8 having an air bladder disposed along a length of an inner surface 10 of the headband 6. Inflatable and deflatable air bladder cushion 8 includes a plurality of individualized cushions 18. In one example, the plurality of individualized cushions 18 are delineated by a heat seal pattern 20 on a surface of the inflatable and deflatable air bladder cushion 8. FIG. 3 illustrates a perspective view of the individualized cushions 18 delineated by a heat seal pattern 20. Inflatable and deflatable air bladder cushion 8 includes an air pump operable by a user arranged to insert air into the air bladder and a valve 40 operable by a user arranged to release air from the air bladder. In one example, the air pump and valve are integrated into a single inflation/deflation unit.

Figure 5A:
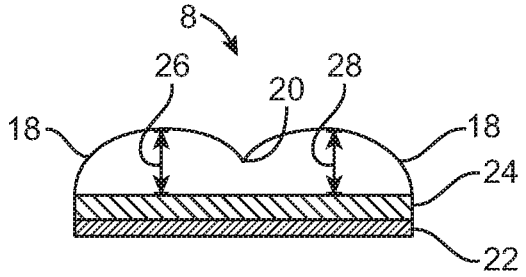
FIGS. 5A-5C illustrate cross-sectional views of the air bladder cushion shown in FIG. 1 in a direction perpendicular to the length of the headband.
Figure 5B:
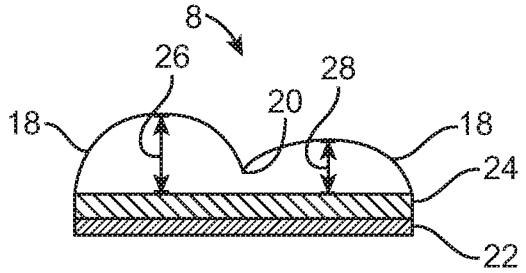
Figure 5C:
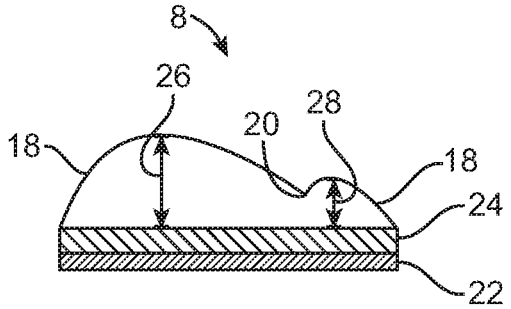

FIGS. 5A-5C illustrate cross-sectional views of the air bladder cushion 8 shown in FIG. 1 in a direction perpendicular to the length of the headband. In one example, the plurality of individualized cushions 18 are configured so that when the inflatable and deflatable air bladder cushion 8 is in an inflated state at least one individualized cushion 18 has a maximum height 26 with respect to the inner surface 10 of the headband 6 different from a maximum height 28 of a second individualized cushion 18, as shown in FIGS. 5B-5C. Heat seal pattern 20 design may be used to control the height of individual cushions.

At least one individualized cushion 18 has a contoured surface 12 having a varying height 16 with respect to the inner surface 10 of the headband 6, as shown in FIG. 2. An individualized cushion 18 has a maximum height 14 arranged to contact a high stability contact point on a user head.

Headband 6 includes a foam layer 24 arranged along a length of the length of the inner surface 10 of the headband 6, as shown in FIGS. 5A-5C. In one example, the foam layer 24 is disposed within the inflatable and deflatable air bladder cushion 8. Foam layer 24 operates as a cushion and advantageously provides structure when air bladder cushion 8 is deflated. In a further example, the foam layer 24 is disposed outside the inflatable and deflatable air bladder cushion 8 between inner surface 10 and the air bladder cushion 8.

FIGS. 5A-5C illustrate cross-sectional views of the air bladder cushion 8 shown in FIG. 1 in a direction perpendicular to the length of the headband (i.e., in a direction from the front of the user head towards the back of the user head) in various examples. Referring to FIG. 5A, a first individualized cushion 18 has a maximum height 26 and a second individualized cushion 18 has a maximum height 28. Advantageously, this provides multiple contact points in the direction from the front of the user head towards the back of the user head, resulting in increased stability of the worn headphone 1. In the example shown in FIG. 5A, the maximum height 26 is equal to the maximum height 28. In the example shown in FIG. 5B and FIG. 5C, the maximum height 26 is different from the maximum height 28. In addition to controlling height of individual cushions 18, width of individual cushions 18 may also be controlled at any point on the headband 6 to increase fit and comfort. In the example shown in FIG. 5C, the heat seal 20 is not centered along the width of the headband.

Figure 6A:
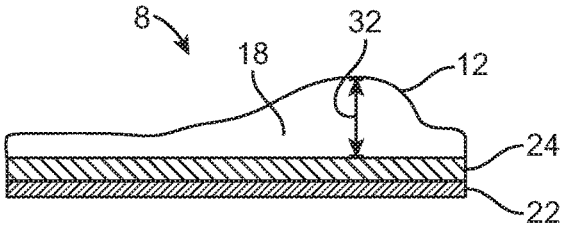
FIGS. 6A-6B illustrate cross-sectional views of the air bladder cushion shown in FIG. 1 in a direction along the length of the headband.
Figure 6B:
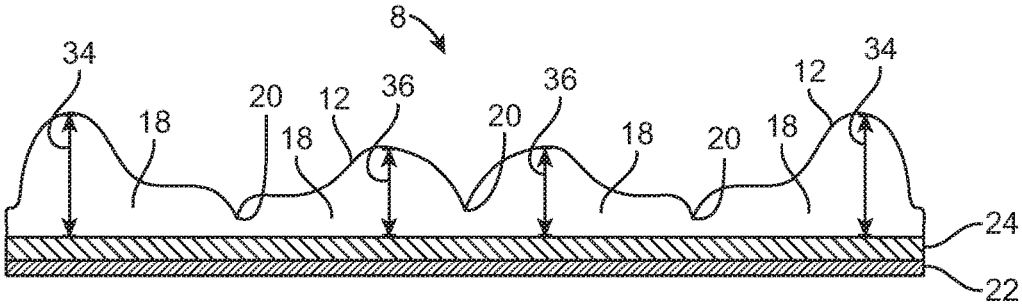

FIGS. 6A-6B illustrate cross-sectional views of the air bladder cushion 18 shown in FIG. 1 in a direction along the length of the headband (i.e., in a direction from ear-to-ear) in one example. Advantageously, as shown in FIGS. 6A-6B, height of individual cushions 18 is controlled along the length of headband 6 in order to contact high stability contact points on the user head when headphones 1 are worn. FIG. 6A illustrates a cross-section of a single individualized air bladder cushion 18 with contoured surface 12 having a maximum height 32. FIG. 6B illustrates a cross-section of the entire length of the air bladder cushion 8, creating a height profile of the air bladder cushion 8 in this direction. As described previously, individualized cushions 18 are delineated by heat seal pattern 20. Advantageously, the contoured surface 12 has corresponding peaks (i.e., maximum height 34) on the left and right side to create high stability contact points on the sides of the user head above the wearer left ear and wearer right ear. The contoured surface also has corresponding peaks (i.e., height 36) on the left and right side to create high stability contact points on a user head adjacent the crown on the top of the user head.

Figure 7:
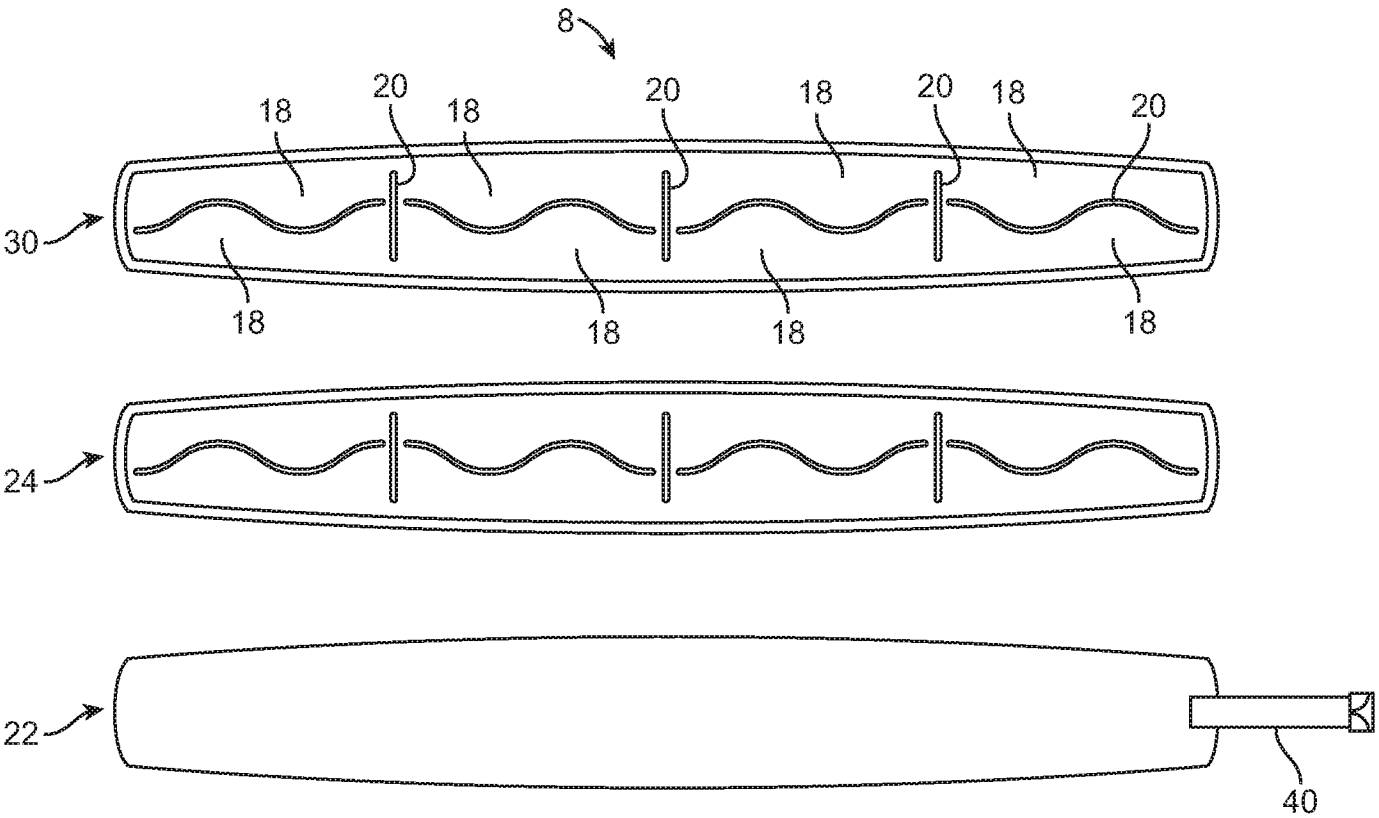
FIG. 7 illustrates a deconstructed top view of the air bladder cushion having an example heat seal pattern.
Figure 8:
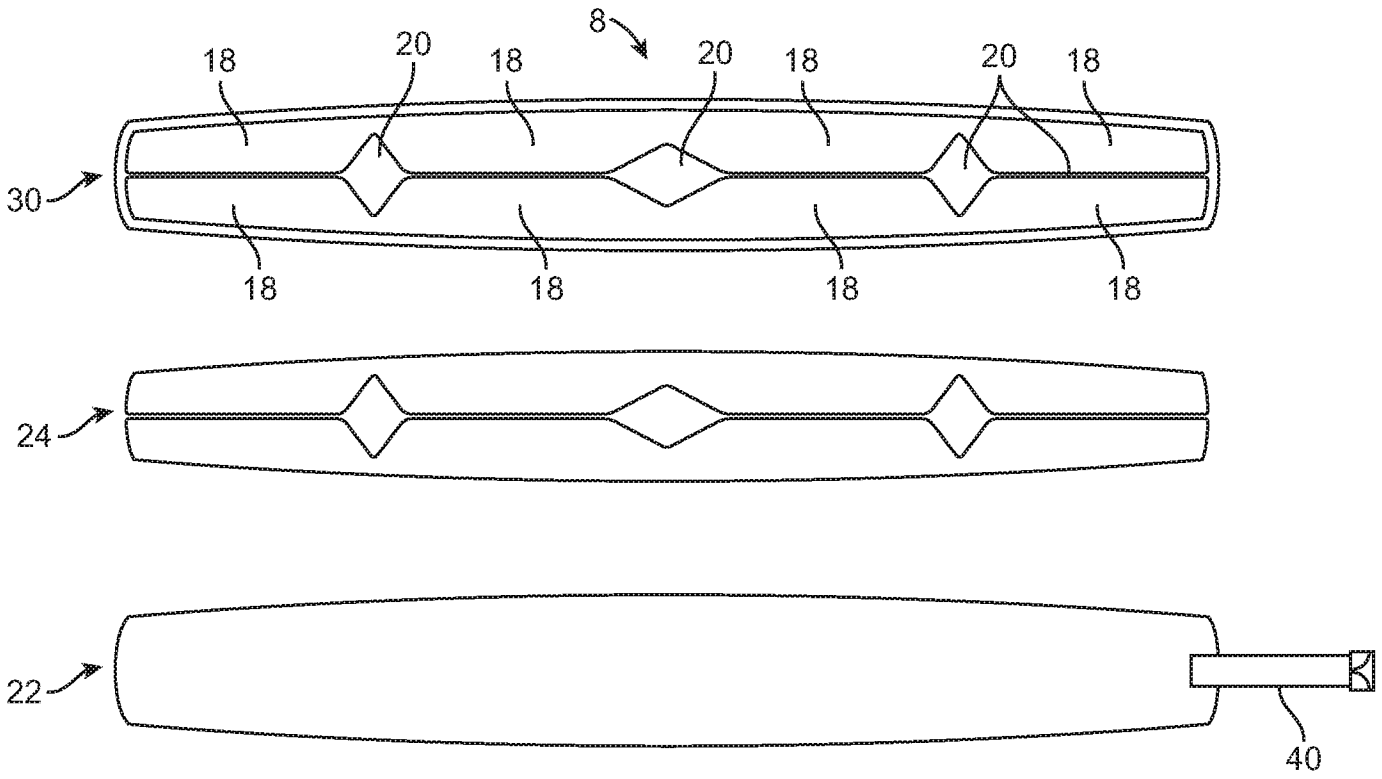
FIG. 8 illustrates a deconstructed top view of the air bladder cushion having a further example heat seal pattern.

FIG. 7 illustrates a deconstructed top view of the air bladder cushion 8 having an example heat seal pattern 20. Air bladder cushion 8 includes a base layer 22, foam layer 24, and top layer 30 (i.e., an air bladder). For example, base layer 22 is a plastic material. Valve 40 is operable by a user arranged to maintain and release air from the inflatable and deflatable air bladder cushion 8. FIG. 8 illustrates a deconstructed top view of the air bladder cushion 8 having a further example heat seal pattern 20.

Figure 10:
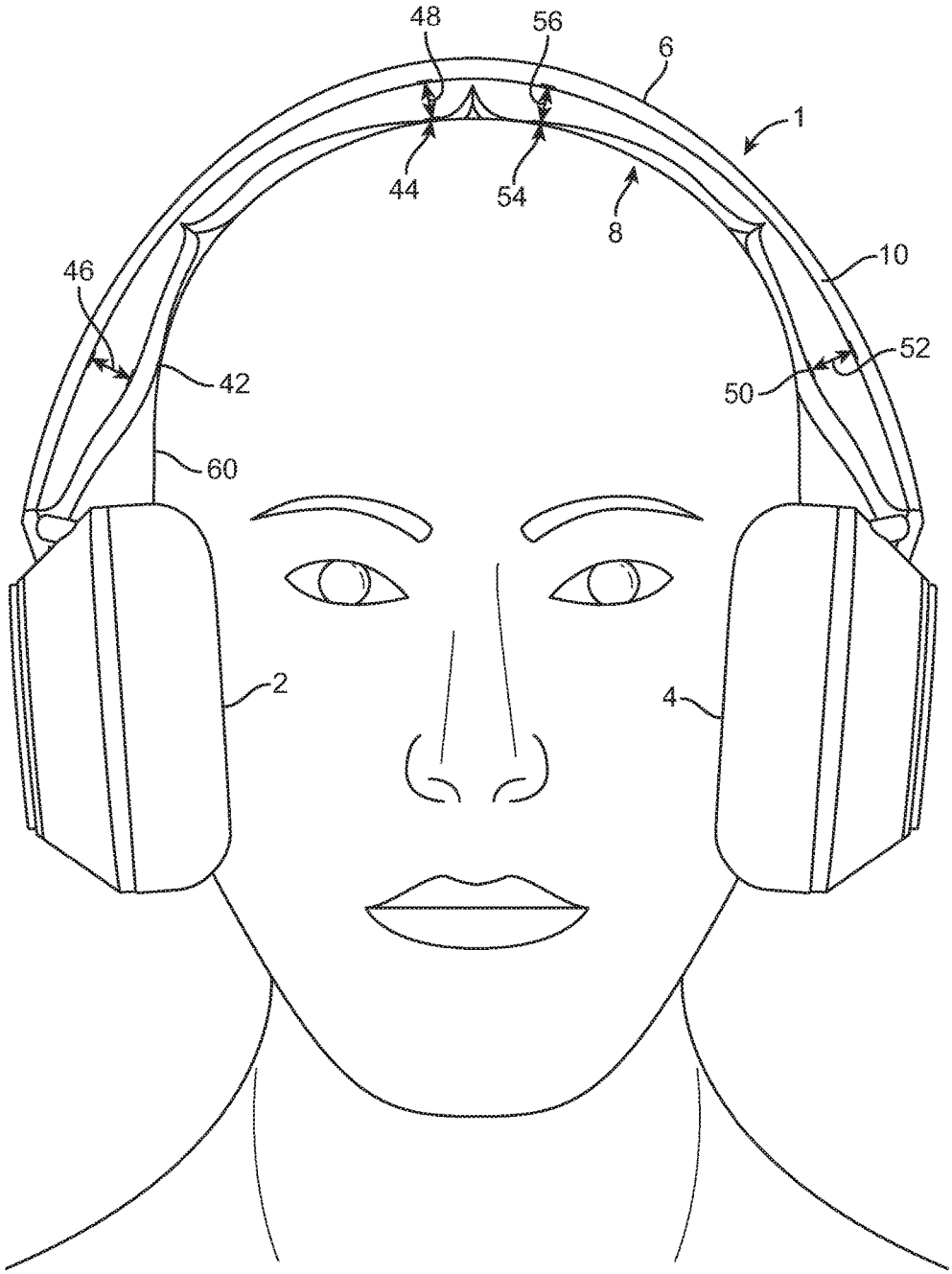
FIG. 10 illustrates a use case of the headphone having an air bladder cushion worn on a user head in one example.

In operation, the air bladder cushion 8 is positioned on the wearer's head when the user puts on the headphone 1. The size of the air bladder cushion 8 self-adapts (i.e., automatically conforms) to the wearer's head as it is inflated, accommodating a variety of head sizes. FIG. 10 illustrates a use case of the headphone 1 having an air bladder cushion 8 worn on a user head 60 in one example. Advantageously, when air bladder cushion 8 is inflated by the user, it has a varying height along its length: At peak heights 46 and 52, contact and pressure is applied to high stability contact points 42 and 50 on the user head 60 above the user ears, respectively. Similarly, at local peak heights 48 and 56, contact and pressure is applied to high stability contact points 44 and 54 on the user head 60 adjacent the crown on the top of the user head, respectively.

While the exemplary embodiments of the present invention are described and illustrated herein, it will be appreciated that they are merely illustrative and that modifications can be made to these embodiments without departing from the spirit and scope of the invention. Certain examples described utilize headphones which are particularly advantageous for the reasons described herein. In some instances, not all acts may be required to be implemented in a methodology described herein.

Thus, the scope of the invention is intended to be defined only in terms of the following claims as may be amended, with each claim being expressly incorporated into this Description of Specific Embodiments as an embodiment of the invention.

What is claimed is:

1. A head-worn device comprising:

a left earphone assembly;

a right earphone assembly;

a headband having a first end coupled to the left earphone assembly and a second end coupled to the right earphone assembly, the headband comprising:

an inflatable and deflatable air bladder cushion disposed along a length of an inner surface of the headband, the inflatable and deflatable air bladder cushion comprising: a plurality of individualized cushions configured so that when the inflatable and deflatable air bladder cushion is in an inflated state at least one individualized cushion has a first maximum height with respect to the inner surface of the headband different from a second maximum height of a second individualized cushion, and at least one individualized cushion has a contoured surface having a varying height with respect to the inner surface of the headband; and a foam layer arranged along a length of the inner surface of the headband.

2. The head-worn device of claim 1, wherein the foam layer is disposed within the inflatable and deflatable air bladder cushion.

3. The head-worn device of claim 1, wherein the plurality of individualized cushions are delineated by a heat seal pattern on a surface of the inflatable and deflatable air bladder cushion arranged to face a user head.

4. The head-worn device of claim 1, wherein a cross-section of the inflatable and deflatable air bladder cushion perpendicular to the length of the headband comprises a first individualized cushion having a first height and a second individualized cushion having a second height.

5. The head-worn device of claim 4, wherein the first height is equal to the second height.

6. The head-worn device of claim 4, wherein the first height is different from the second height.

7. The head-worn device of claim 1, wherein the at least one individualized cushion having the contoured surface having the varying height with respect to the inner surface of the headband has a peak height arranged to contact a high stability contact point on a user head.

8. The head-worn device of claim 7, wherein the high stability contact point on a side of a user head above a user ear.

9. The head-worn device of claim 7, wherein the high stability contact point on a user head is adjacent the crown on the top of the user head.

10. The head-worn device of claim 1, further comprising an air pump operable by a user arranged to insert air into the inflatable and deflatable air bladder cushion.

11. The head-worn device of claim 1, further comprising a valve operable by a user arranged to release air from the inflatable and deflatable air bladder cushion.

12. An air bladder headband cushion comprising:

a base layer arranged to be attached to a headband;

an inflatable and deflatable air bladder cushion disposed along a length of an inner surface of the base layer, the inflatable and deflatable air bladder cushion comprising: a plurality of individualized cushions configured so that when the inflatable and deflatable air bladder cushion is in an inflated state at least one individualized cushion has a first maximum height with respect to the inner surface of the headband different from a second maximum height of a second individualized cushion, and at least one individualized cushion has a contoured surface having a varying height with respect to the inner surface of the headband; and a foam layer.

13. The air bladder headband cushion of claim 12, wherein the foam layer is disposed within the inflatable and deflatable air bladder cushion.

14. The air bladder headband cushion of claim 12, wherein the plurality of individualized cushions are delineated by a heat seal pattern on a surface of the inflatable and deflatable air bladder cushion arranged to face a user head.

15. The air bladder headband cushion of claim 12, wherein a cross-section of the inflatable and deflatable air bladder cushion perpendicular to the length of the headband comprises a first individualized cushion having a first height and a second individualized cushion having a second height.

16. The air bladder headband cushion of claim 15, wherein the first height is equal to the second height.

17. The air bladder headband cushion of claim 15, wherein the first height is different from the second height.

18. The air bladder headband cushion of claim 12, wherein the at least one individualized cushion having the contoured surface having the varying height with respect to the inner surface of the headband has a peak height arranged to contact a high stability contact point on a user head.

19. The air bladder headband cushion of claim 18, wherein the high stability contact point on a side of a user head above a user ear.

20. The air bladder headband cushion of claim 18, wherein the high stability contact point on a user head is adjacent the crown on the top of the user head.

21. The air bladder headband cushion of claim 12, further comprising an air pump operable by a user arranged to insert air into the inflatable and deflatable air bladder cushion.

22. The air bladder headband cushion of claim 12, further comprising a valve operable by a user arranged to release air from the inflatable and deflatable air bladder cushion.

* * * * *